United States Patent [19]

Mueller et al.

[11] Patent Number: 4,778,164

[45] Date of Patent: Oct. 18, 1988

[54] LOCKING APPARATUS FOR FLOOR MOUNT CONNECTOR

[75] Inventors: Wolfgang Mueller; Arthur T. Nagare, both of Erie, Pa.

[73] Assignee: American Sterilizer Company, Erie, Pa.

[21] Appl. No.: 35,675

[22] Filed: Apr. 7, 1987

[51] Int. Cl.[4] ..... A61G 13/00

[52] U.S. Cl. ..... 269/322

[58] Field of Search ..... 403/316, 317, 324; 108/143, 144, 447, 1, 57; 269/322-326; 372/204, 195-196; 5/62, 63; 74/527

[56] References Cited

U.S. PATENT DOCUMENTS

| | | | |
|---|---|---|---|
| 3,154,967 | 11/1964 | Voland | 74/527 |
| 3,362,704 | 1/1968 | Pilz | 269/325 |
| 4,243,342 | 1/1981 | Marto | 403/329 |
| 4,477,202 | 10/1984 | Price | 403/324 |
| 4,484,510 | 11/1984 | Hirzel | 74/527 |

*Primary Examiner*—Robert C. Watson

*Attorney, Agent, or Firm*—Kirkpatrick & Lockhart

[57] ABSTRACT

Apparatus for blocking the release of a surgical table from engagement with a floor bracket is provided. In a surgical table having a foot lever which actuates a bar to cause the release of connecting means from a tongue of a floor bracket, a vertical pin is provided on the bar. A base plate having a slot therein is provided on the lower portion of the surgical table adjacent to the pin. A blocking plunger of a first pulling solenoid may be extended across the slot to block the movement of the pin to prevent the displacement of the bar and the release of the connecting means from the tongue. The extension of the blocking plunger is caused by the retraction of an extension plunger of a second solenoid, which extension plunger is parallel to but disposed above the blocking plunger and is connected to the blocking plunger by a connecting block. The extension of the blocking plunger causes a cam surface on the connecting block to engage a cam follower to actuate a microswitch which produces a signal indicating the blocking of the pin. The blocking plunger may be retracted from its blocking position by being retracted by the first solenoid to free the pin and allow release of the surgical table from the floor bracket.

23 Claims, 5 Drawing Sheets

LOCKING APPARATUS FOR FLOOR MOUNT CONNECTOR

BACKGROUND OF THE INVENTION

Reference is made to the following United States patent applications which were filed on the same date as the present application, are owned by the same assignee as the present application and which are employed on the same commercial apparatus as this invention: Ser. No. 35,674 and Ser. No. 35,529.

FIELD OF THE INVENTION

The present invention relates to a device for securing a movable object to a floor-mounted bracket and, in particular, to a device for securing a surgical table to a pivotable floor mounting device.

DESCRIPTION OF THE PRIOR ART

In a variety of applications, it has proven useful to secure a portable object to a floor by means of a floor-mounted device to which the object may be attached. For example, in the surgical table art, a surgical table may be portable by means of wheels provided thereon. When it is desired to fix such a surgical table at a specified location, to stabilize it and to provide electrical energy to the table, a connecting mechanism on the table is caused to engage a floor-mounted receptacle or bracket. The bracket may include a base plate on which there is provided a flange which is engaged by the table's connecting means, electrical contacts and an extended, notched tongue which may be engaged by a releasable attaching means provided as part of the table's connecting means. The table's attaching means may include spring-biased pins for engaging the notches on the tongue and a foot pedal-actuated lever system for releasing the pins from the tongue. As such, the table may be connected to the bracket and released therefrom at any time by the actuation of the foot pedal to cause the connecting means to be ejected from the tongue.

As will be appreciated by those skilled in the art, situations arise in which it is necessary to prevent the disengagement of a table from a floor bracket. Such prohibition of disengagement may be necessary to foreclose the possibility of the loss of electrical power to the table or to assure the physical stabilization of the table by means of its attachment to the floor bracket. An example of the last-mentioned situation has been presented relative to surgical or other tables, the tops of which may be displaced longitudinally and/or laterally from a home stabilized position while supporting a surgical patient. It is clear that if the top of such a table were displaced and the table released from the floor bracket, an unstable condition would result in which the table could overturn while supporting a patient.

Heretofore, there has been no suitable means available to prevent the release of a surgical table from a floor-mounted bracket. As such, it is important that means be provided to prevent at certain times the disengagement of a surgical table from a floor bracket. Such means should provide that the device retain the table either locked or unlocked to the floor bracket in the event of a power failure depending on its condition prior to the outage. The connecting means should also be difficult to overcome manually, and provide that the purposeful or inadvertent application of foot pedal pressure not release the connection and that the device be physically compatible, especially in terms of overall size, with the limitations of surgical tables.

The subject invention is directed toward a means for preventing the undesired disengagement of a portable device from a floor bracket therefor which overcomes, among others, the above-discussed problems and which provides a failsafe blocking device which is effective in locking a portable object to a floor-mounted bracket and preventing disengagement therefrom when such would be hazardous.

SUMMARY OF THE INVENTION

In accordance with the present invention, there is provided apparatus for joining a portable object to a floor-mounted bracket. In a preferred embodiment of the invention discussed hereinbelow, a surgical table having a horizontally displaceable tabletop may be locked to a pivotable floor-mounted bracket, which bracket has an extended, horizontal spade-like tongue which may be releasably engaged by a connecting means provided on the table. The table's connecting means includes pins which may engage the tongue of the floor bracket and be released from such engagement by means of linkages connected to a bar which may be manually actuated by a foot pedal.

The blocking mechanism provided herein includes a vertical pin secured to the bar of the foot pedal release mechanism. A plate attached to the lower portion of the surgical table is provided with a slot in which the vertical pin passes. In order to prevent the release of the table connecting means from the tongue, the movement of the pin of the foot pedal bar is prohibited by the cooperation of the slot and a blocking plunger system. Dual electric pulling solenoids are mounted on the plate on opposite sides of the slot with the plungers thereof in horizontally parallel, yet vertically spaced, relation. The plungers are joined for unitary movement by a connecting block which includes a cam surface. When a first electrical switch is actuated, one solenoid is activated and it pulls the plunger thereof which acts as an extension plunger and serves to extend the plunger of the other solenoid which acts as a blocking plunger. The blocking plunger is thereby moved into a position transverse to the slot at an elevation intended to interfere with the movement of the pin in the slot. Accordingly, when the blocking plunger is extended, the pin is locked into position in the slot which prevents movement of the bar and, hence, of the foot pedal. Such prohibition of movement prevents the pins from being removed from engagement with the tongue of the floor bracket so that the table may not be disengaged from the floor bracket. When another switch is actuated, the other solenoid is activated and it pulls the blocking plunger from interference with the pin and places the extension plunger in a position in which it is extended above the slot and at an elevation above that of the top of the pin thereby allowing pin movement in the slot.

When the extension plunger is retracted thereby extending the blocking plunger, the cam surface of the plunger connecting block engages a cam roller mounted on a microswitch. The cam surface is shaped such that when it is engaged by the cam roller, the blocking plunger is further retained in its blocking position through the spring load of the cam roller on the cam surface. The engagement of the cam roller with the cam surface produces an electrical signal which indicates that the table is secured to the floor bracket. When the table is secured to the floor bracket, the top of the table may be safely displaced. Additionally, means are provided to guide the plungers along their respective axes and prevent lateral displacement thereof.

Accordingly, the present invention provides solutions to the aforementioned problems relative to the securing of a portable object to a floor bracket. As this invention provides an effective blocking means, the problems associated with the improper or unintentional release of a portable surgical table from a floor bracket are overcome. Further, the present invention provides a failsafe device for maintaining a locked or an unlocked condition without requiring continued electrical power.

These and other details, objects and advantages of the invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE PREFERRED EMBODIMENTS

Figure 1:
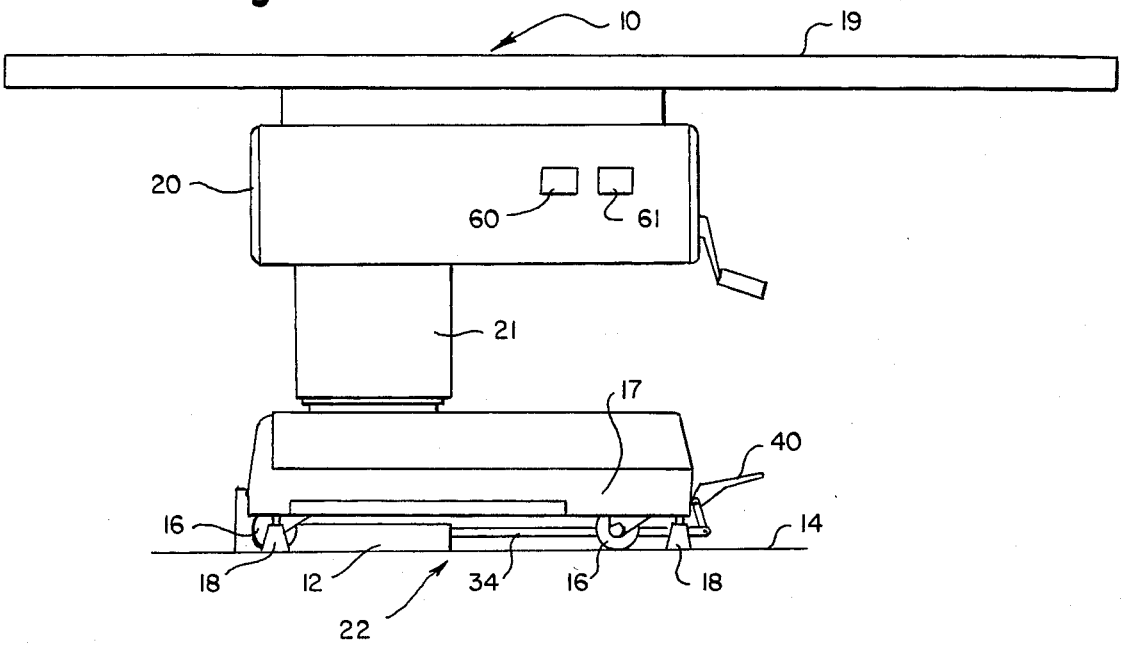
FIG. 1 is a side elevation view of a surgical table and a floor-mounted bracket.
Figure 7:
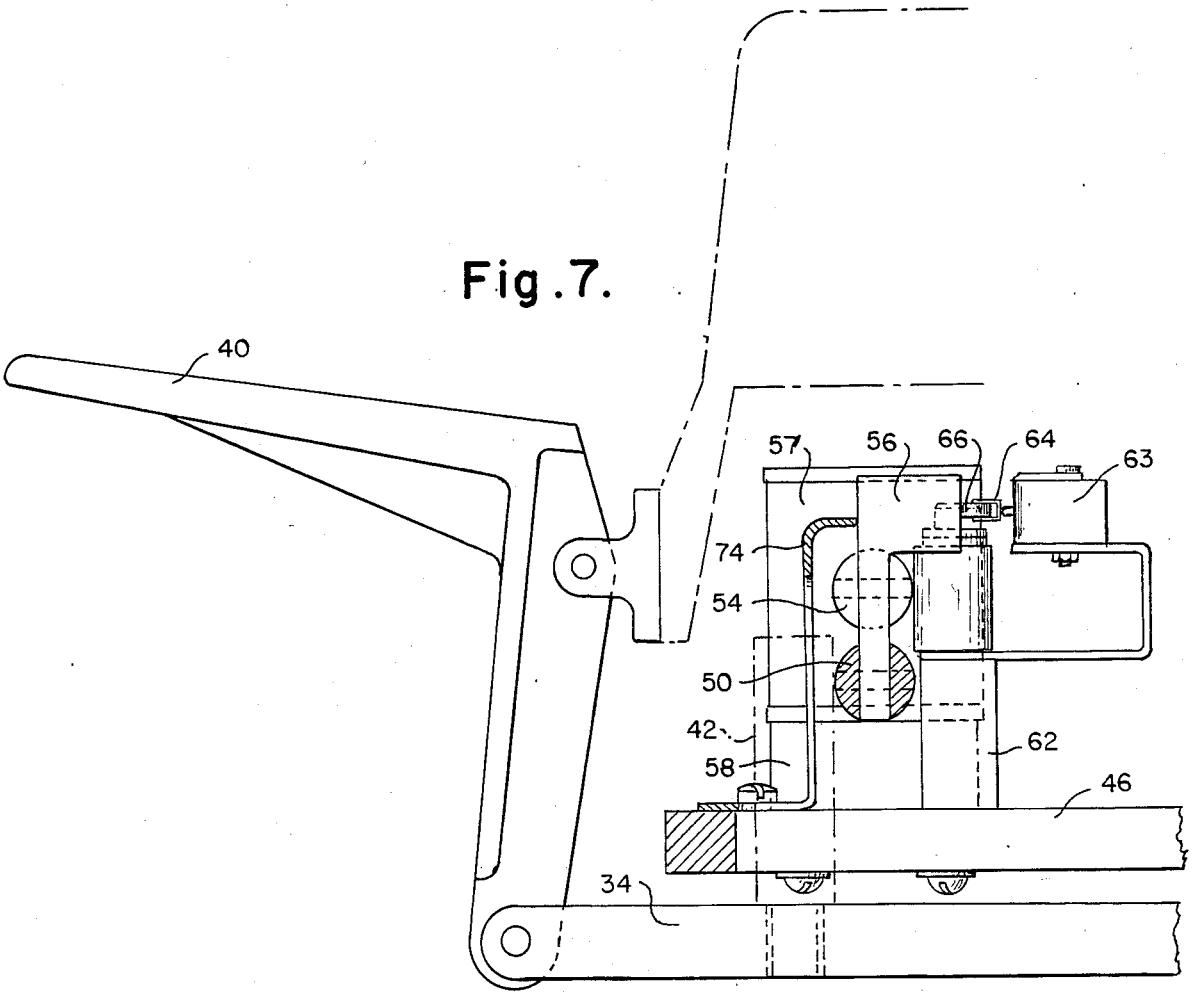
FIG. 7 is a side elevation sectional view of the locking device provided herein taken along lines VII—VII in FIG. 6.
Figure 2:
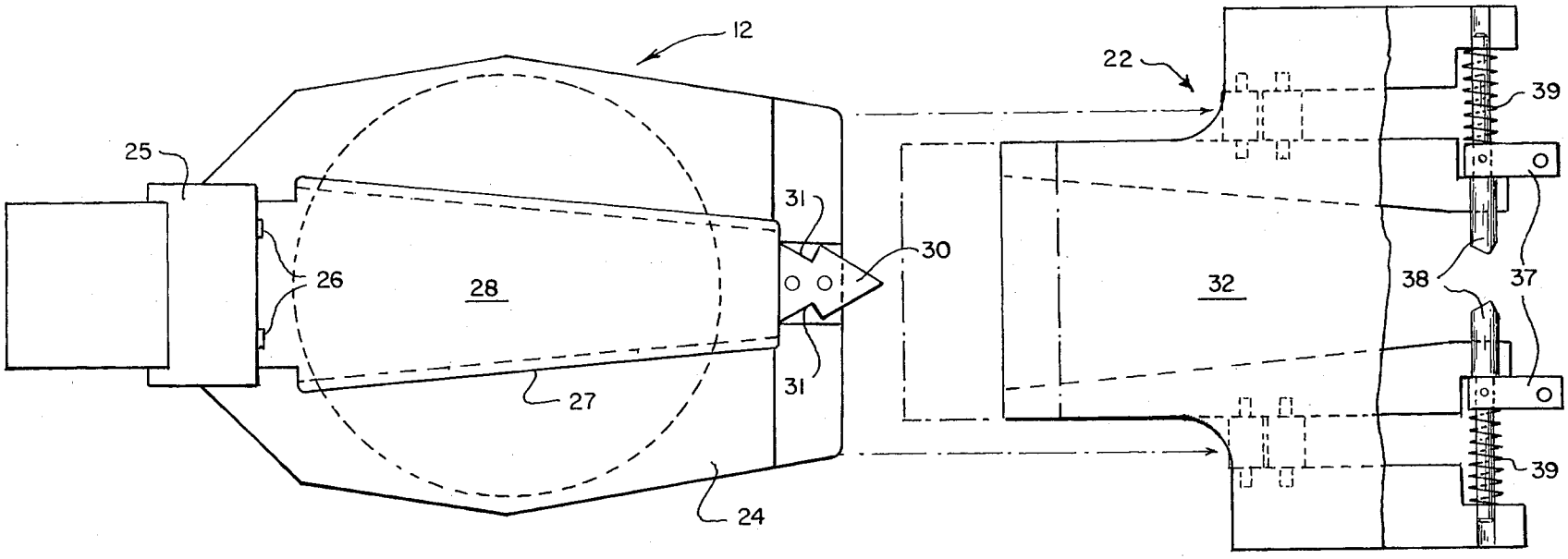
FIG. 2 is a plan view of a floor-mounted bracket to which a surgical table may be attached in juxtaposition to a bracket engaging means for a surgical table.
Figure 3:
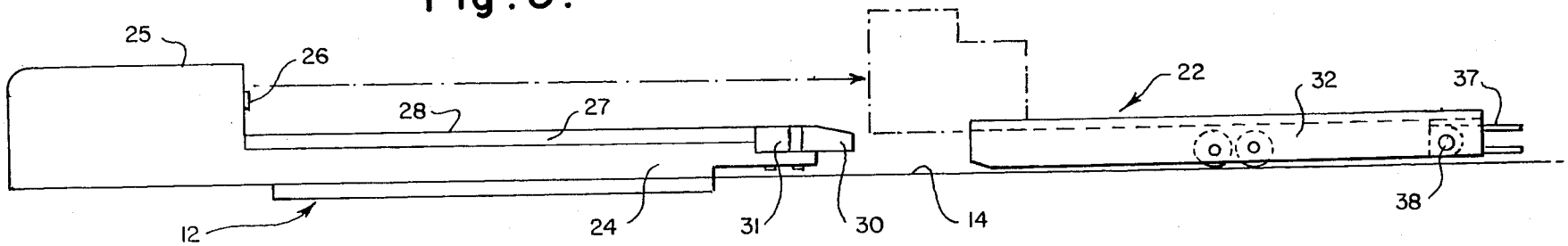
FIG. 3 is a side elevation view of a floor-mounted bracket to which a surgical table may be attached in juxtaposition to a bracket engaging means for a surgical table.
Figure 4:
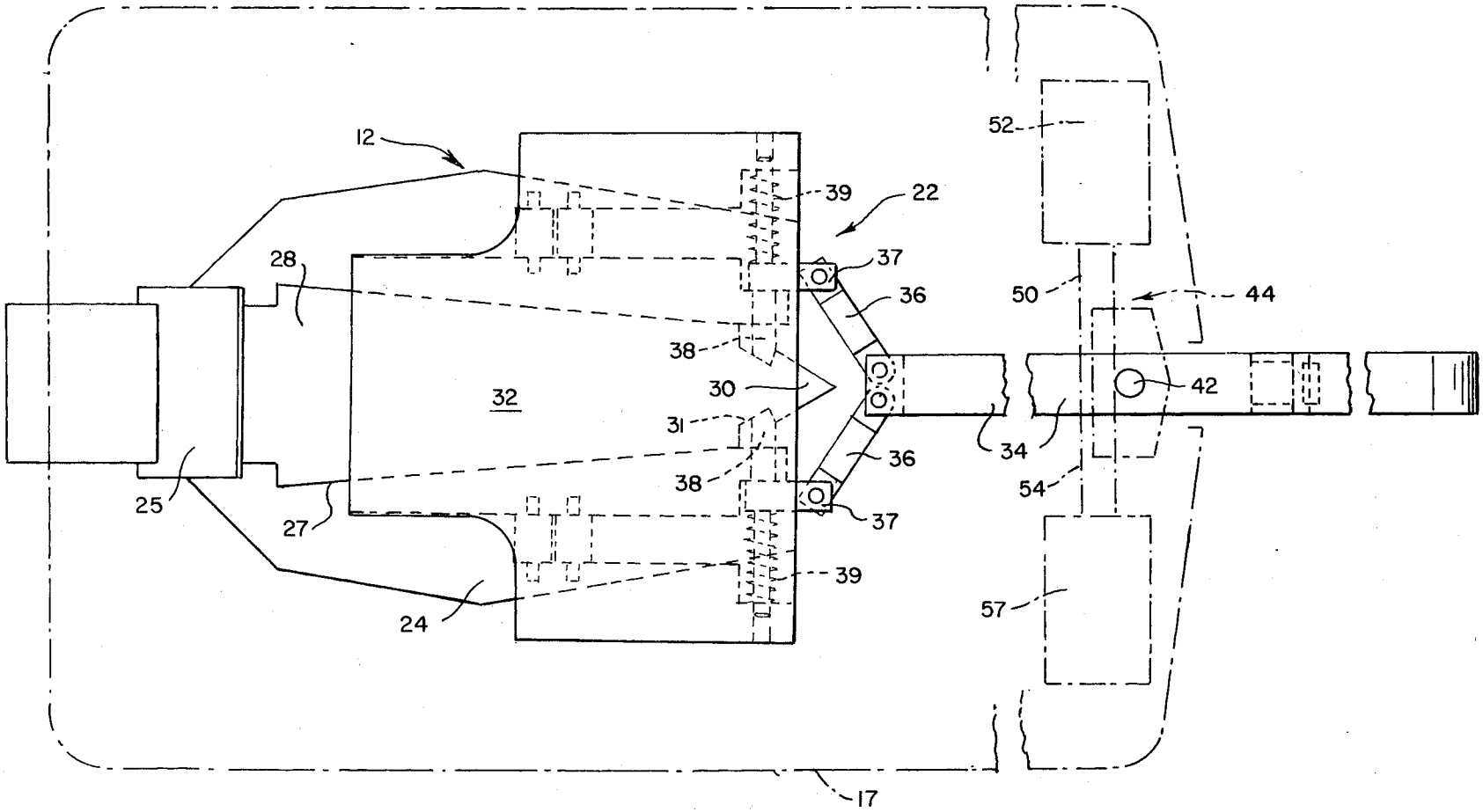
FIG. 4 is a bottom plan view of a floor-mounted bracket which is engaged by the bracket engaging means of a surgical table.
Figure 5:
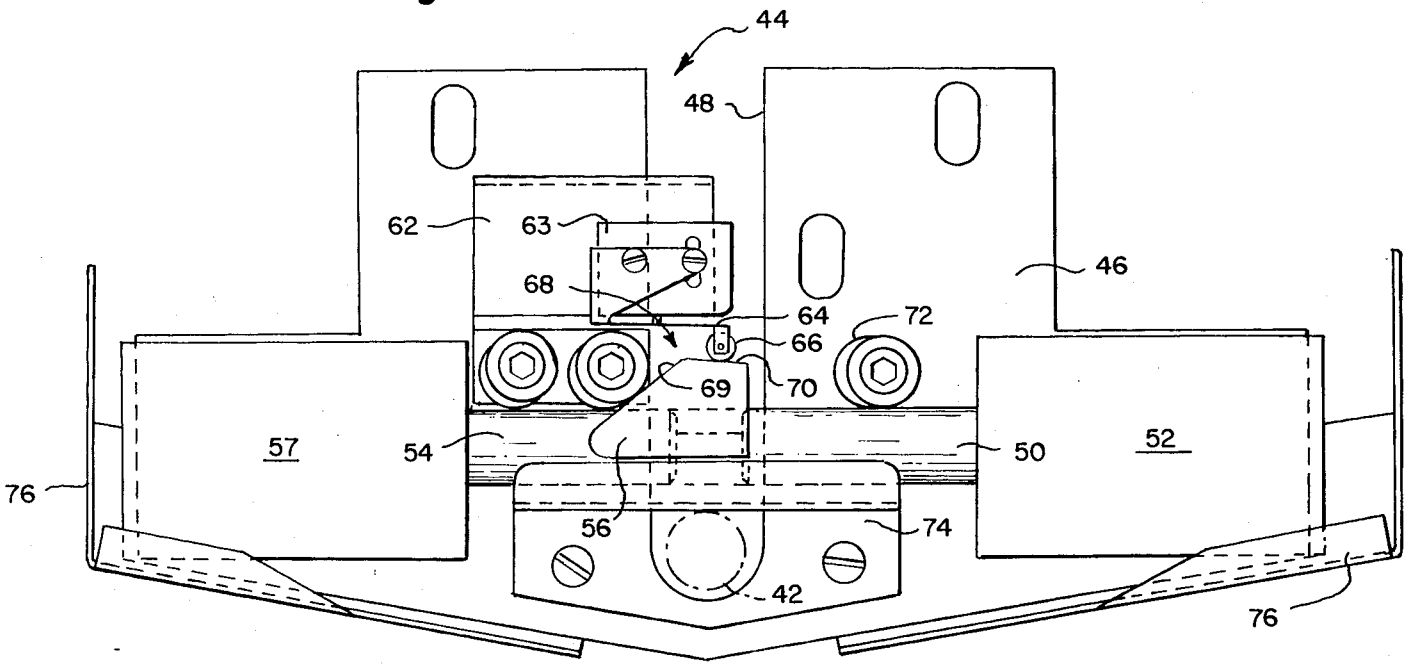
FIG. 5 is a plan view of the locking device provided herein.
Figure 6:
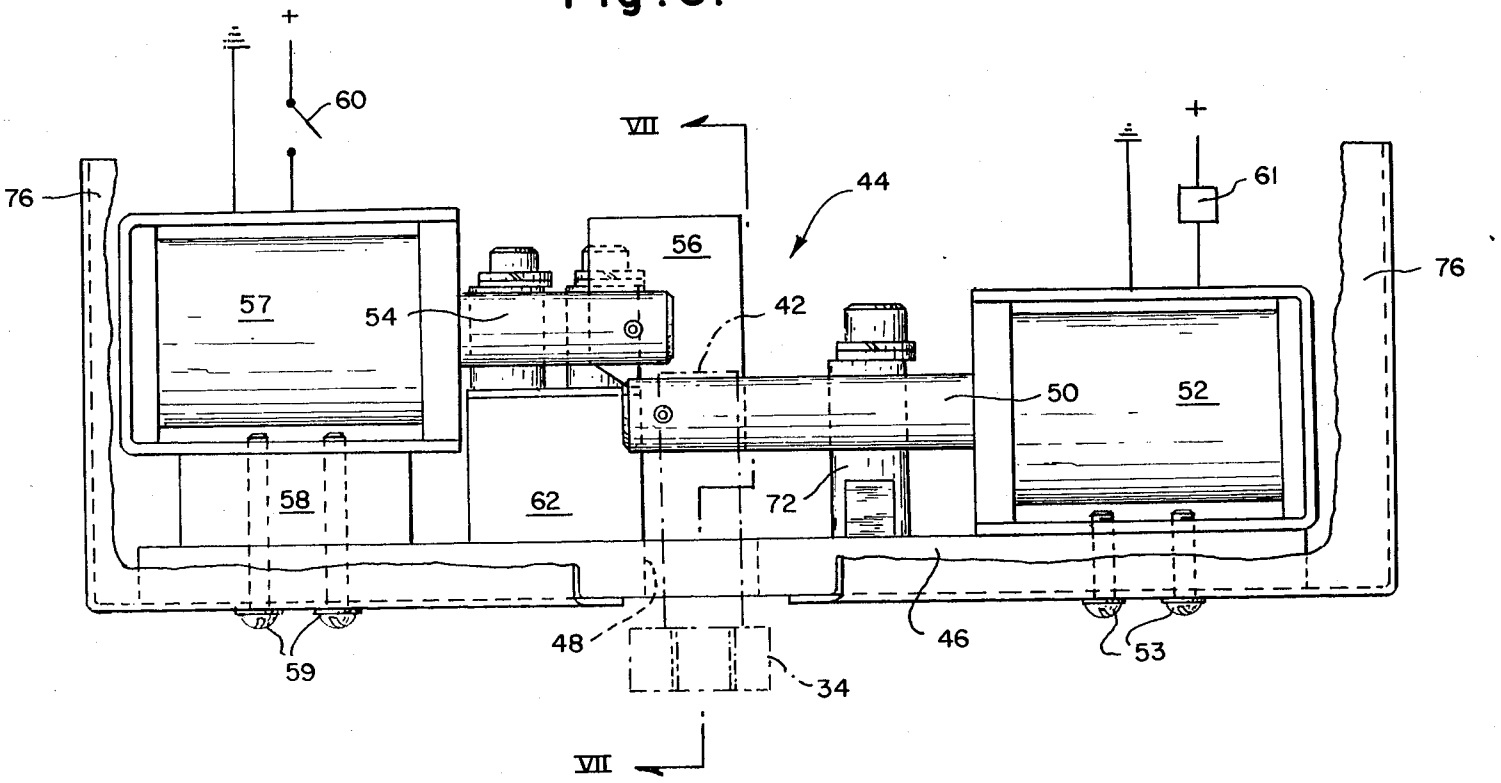
FIG. 6 is a front elevation view of the locking device provided herein with the guide bracket removed for clarity.

Referring now to the drawings wherein the showings are for purposes of illustrating the present preferred embodiment of the invention and not for purposes of limiting same, the figures show a portable surgical table 10 which may be connected to a floor-mounted bracket 12 pivotably mounted on a floor 14.

The surgical table 10 may be portable on wheels 16 mounted on a base 17 thereof and may be lowered onto legs 18 for rigid support in a given position. The top 19 of surgical table 10 is supported on a support means 20 which, in turn, is supported on a pedestal 21 which extends upwardly from base 17. The top 19 may be displaceable relative to support means 20 both longitudinally and laterally. Floor bracket connecting mechanism, generally 22, is provided on the base 17 to connect table 10 to floor bracket 12.

Floor bracket 12 typically includes a base plate 24 which supports an electrical box 25 having electrical contacts 26 extending therefrom. The flange-like edges 27 of an upper plate 28 may be engaged by corresponding structure in the table's connecting mechanism 22 to connect the table 10 to the floor bracket 12. Also, the extended tongue 30 of floor bracket 12 is engaged by connecting mechanism 22 which is provided on base 17 of table 10. For the purposes of the present invention, the part of floor bracket 12 which is of greatest interest is tongue 30 having notches 31.

Connecting means 22 includes a frame 32 attached to table base 17 on which there is mounted a slidable bar 34. One end of bar 34 is pivotally connected to laterally extending links 36. Links 36 are pivotally connected by means of arms 37 to pins 38 which engage the notches 31 on either side of tongue 30 when the connecting means 22 is in engagement with floor bracket 12. The free ends of pins 36 are normally biased by springs 39 into engagement with the notches 31 of tongue 30. As such, when the connecting means 22 is engaged with floor bracket 12, pins 38 serve to lock the table 10 to tongue 30. A foot pedal 40 is pivotally connected to the opposite end of bar 34 such that the depressing of foot pedal 40 causes bar 34 to be displaced toward tongue 30 thereby causing links 36 to draw pins 38 from engagement with the notches 31 while simultaneously causing the end of bar 34 to which links 36 are connected to contact and push against the tip of tongue 30 to cause the connecting means 22 and, hence, the table 10 to be displaced away from floor bracket 12.

The engagement of table 10 with floor bracket 12 allows the floor bracket electrical contacts 26 to be engaged by corresponding contacts in the base portion 17 of table 10. Additionally, the engagement of table 10 with floor bracket 12 causes the table to be fixed to the floor 14 in order to stabilize the table 10 in the event the top 19 is displaced from its balanced home position. It will be readily appreciated that if a patient was placed on table 10 and the table 10 was not secured to floor 14, if the top 19 was displaced, the table 10 carrying the surgical patient may be capable of overturning.

Accordingly, the present invention is directed to a means for preventing the inadvertent release of table 10 from floor bracket 12. In order to prohibit the undesired movement of bar 34 which causes the release of connecting means 22 from tongue 30, a vertical pin 42 is provided on bar 34 in proximity to foot pedal 40. It is the preventing of movement of the bar 34 by the retention of pin 42 by the present invention which causes the connecting means 22 to be secured to the tongue 30.

In accordance with the present invention, there is provided a blocking mechanism 44 which locks pin 42 in position thereby preventing the release of connecting means 22 from tongue 30. Blocking mechanism 44 includes a base plate 46 which is affixed to the base portion 17 of table 10 and which is provided with a closed-ended slot 48. When foot pedal 40 is actuated, pin 42 is allowed to move within slot 48 to cause the movement of bar 34 and the release of pins 38 from tongue 30.

In order to prevent the movement of pin 42 and, hence, prohibit the movement of bar 34 to disengage pins 38 from the notches 31 in tongue 30 and thereby release connecting means 22 from floor bracket 12, a blocking plunger 50 is provided. Blocking plunger 50 comprises the plunger of a first pulling electric solenoid 52 mounted on plate 46 by means of screws 53. Blocking plunger 50 is provided to extend laterally across slot 48 at an elevation beneath the top end of pin 42 such that the extension of plunger 50 blocks the movement of pin 42 in slot 48. For purposes of clarity, the direction "up" will be taken as that from floor 14 toward surgical table-top 19 with other directions being relative thereto. Blocking plunger 50 is moved into its blocking position by means of extension plunger 54 which is connected to it by means of connecting block 56 which is affixed to blocking plunger 50 and to extension plunger 54. Extension plunger 54 is mounted horizontally parallel to blocking plunger 50 yet in vertically spaced relation thereto such that extension plunger moves in a plane above the upper end of pin 42. Extension plunger 54 comprises the plunger of a second pulling electric solenoid 57 which is mounted in an elevated position on base plate 46 on a spacer block 58 by means of screws 59. As such, when second solenoid 57 is energized, extension plunger 54 is retracted thereby drawing, by means of connecting block 56, blocking plunger 50 into its extended position blocking the movement of pin 42 along slot 48. When the first solenoid 52 is activated, the blocking plunger 50 is retracted thereby extending extension plunger 54 and withdrawing blocking plunger 50 from proximity with pin 42. The activation of second solenoid 57 is caused by the actuation of a first momentary switch 60 which locks the table 10 to the bracket 12. First solenoid 52 is controlled by a second switching means 61 having a logic circuit which is effective to cause first solenoid 52 to release table 10 from bracket 12 either automatically when tabletop 19 has been moved and returned to its home balanced position relative to support 20 or manually if the table 10 was locked to the bracket 22 but tabletop 19 was not displaced.

A support block 62 is also mounted on base plate 46 adjacent to second solenoid 57. Mounted on support block 62 is a microswitch 63 from which extends a flexible arm 64 to which there is mounted a cam follower 66. The side of connecting block 56 remote from the closed end of slot 48 is formed as a cam surface 68 which may engage cam follower 66. As such, when extension plunger 54 is retracted thereby extending blocking plunger 50 into blocking relation with slot 48, a first inclined portion 69 of cam surface 68 is moved into engagement with cam follower 66 thereby causing the displacement of arm 64 and the actuation of microswitch 63. When the microswitch 63 is actuated, it generates a signal which indicates that the blocking plunger 50 is in its slot 48 blocking position thereby indicating that connecting means 22 is locked to tongue 30 and release therefrom is prohibited. Upon the generation of such signal by microswitch 63, the circuitry which enables the displacement of tabletop 19 is activated. Accordingly, top 20 may only be displaced when blocking plunger 50 is extended to block the movement of pin 42 along slot 48.

In a preferred embodiment of the invention, cam surface 68 includes a second inclined portion 70 which is slightly inclined in a direction opposite to that of cam portion 69 to assure that cam follower 66 remains in engagement with cam surface 68 so long as blocking plunger 50 is extended across slot 48. In addition, the spring force created by arm 64 urges cam roller 66 into increased engagement with second cam portion 70 which force further urges blocking plunger 50 into its blocking position by applying a transverse force thereto.

In order to protect plungers 50 and 54 from the force generated by pin 42 against blocking plunger 50 if foot pedal 40 were attempted to be operated while blocking plunger 50 was extended, additional supports for blocking plunger 50 are provided. First, when blocking plunger 50 is extended, it is caused to extend adjacent to and longitudinally in front of support block 62 so that the end of blocking plunger 50 may not be displaced by pin 42 due to the backing force provided by support block 62. Additionally, an eccentric support guide roller 72 is provided adjacent first solenoid 52 to engage blocking plunger 50 and prevent displacement thereof by pin 42. The eccentricity of guide roller 72 allows the adjustment of the engagement thereof with blocking plunger 50. A guide bracket 74 is also provided to control the movements of blocking plunger 50 and extension plunger 54 and to prevent the rotation thereof. An outer surrounding shroud 76 is provided about connecting means 22 and blocking means 44 to protect the internal components thereof from contaminants.

In the operation of the present invention, the surgical table 10 is positioned adjacent to the floor bracket 12 such that the connecting means 22 is immediately adjacent thereto. The table 10 is then urged toward floor bracket 12 which causes the connecting means 22 to engage floor bracket 12 thereby causing the pins 38 of connecting means 22 to pass over the pointed portion of tongue 30 and into engagement with the notches 31 thereof. In this position, the table 10 is secured to floor bracket 12 but may be released therefrom by the depressing of foot pedal 40 which causes the longitudinal displacement of bar 34, and the movement of pin 42 along slot 48, thereby pivoting links 36 which, in turn, pivot pins 38 from engagement with notches 31 of tongue 30. Simultaneously, bar 34 pushes against the tip of tongue 30 which urges the connecting means 22 away from floor bracket 12 and, hence, table 10 therefrom.

When table 10 is secured to floor bracket 12 and it is desired to prevent the disengagement of connecting means 22, for example, to allow tabletop 19 to be displaced from its home position, blocking mechanism 44 is activated by switch 60. A signal from switch 60 causes extension solenoid 57 to retract extension plunger 54 which, by virtue of its connection to blocking plunger 50 by means of connecting block 56, causes blocking plunger 50 to be drawn across slot 48 thereby substantially preventing the displacement of pin 42 and, hence, bar 34 to release pins 38 from notches 31. The term "substantially" has been employed to indicate that a sufficient degree of movement of pin 42 to cause an undesired result, here, the release of connecting means 22, has been prevented. The movement of connecting block 56 causes cam follower 66 to ride along first inclined cam surface 69 thereby actuating microswitch 63 to generate an electrical signal indicating that release of locking means 22 from floor bracket 12 is prohibited. Cam follower 66 then passes to inclined surface 70 of cam surface 68 to further assure the engagement of cam follower 66 therewith. The blocking plunger 50 is protected against the movement of pin 42 by pedal 40 by its positioning adjacent support block 62 and against guide roller 72. The movements of blocking plunger 50 and extension plunger 54 are further guided by means of guide bracket 74.

When the release of blocking mechanism 44 is desired, an electrical signal is provided by switch 61 to cause blocking plunger 50 to be retracted by the actuation of first solenoid 52. The retraction of blocking plunger 50 frees the movement of pin 42 in slot 48 and causes the extension of extension plunger 54 and the movement of connecting block 56. Such movement of connecting block 56 causes cam surface 68 to be removed from proximity with cam follower 66 to cause microswitch 63 to cease generating an electrical signal indicative of the actuation of blocking mechanism 44.

It will be understood that various changes in the details, materials and arrangements of parts which have been herein described and illustrated in order to explain the nature of the invention may be made by those skilled in the art within the principal and scope of the invention as expressed in the appended claims.

What is claimed is:

1. Apparatus for preventing movement of a pin in one direction perpendicular to its axis, comprising:

a. a plate having a slot therein, said slot having a closed end adjacent to said pin and said slot extending in said one direction and away from said closed end;

b. a blocking plunger disposed on one axial side of said slot and having its axis perpendicular to the axes of said pin and said slot, said blocking plunger being axially movable from a first position remote from said slot to a second position in which said blocking plunger is extended across said slot so as to substantially prevent the movement of said pin away from said closed end of said slot; and c. means for displacing said blocking plunger between said first position and said second position and between said second position and said first position.

2. Apparatus of claim 1 in which said means for displacing comprises:

a. an extension plunger parallel and in facing relation to said blocking plunger and disposed on the opposite axial side of said slot from said blocking plunger, said extension plunger being axially movable between an extended position in which said extension plunger is above said slot yet does not interfere with the movement of said pin and a retracted position remote from said slot;

b. a connecting means for connecting the end of said blocking plunger facing said extension plunger to the end of said extension plunger facing said blocking plunger such that said plungers are moved in unison;

c. a first movement means for moving said blocking plunger from said second position to said first position thereby moving said extension plunger from said retracted position to said extended position; and d. a second movement means for moving said extension plunger from said extended position to said retracted position thereby moving said blocking plunger from said first position to said second position.

3. Apparatus of claim 2 in which said extension plunger is disposed relative to said blocking plunger in a plane parallel to the axis of said pin and the lowermost portion of said extension plunger is above the end of said pin in proximity to said extension plunger.

4. Apparatus of claim 2 in which said first and second movement means are electrically controlled and said apparatus further comprises means for generating a first electrical signal effective to cause said first movement means to move said blocking plunger from said second position to said first position and for generating a second electrical signal effective to cause said second movement means to move said extension plunger from said extended position to said retracted position.

5. Apparatus of claim 4 in which:

a. said first movement means comprises a first electric pulling solenoid and said blocking plunger comprises the plunger of said first solenoid, the actuation of said first solenoid being effective to move said blocking plunger from said second position to said first position upon the receipt of said first signal; and b. said second movement means comprises a second electric pulling solenoid and said extension plunger comprises the plunger of said second solenoid, the actuation of said second solenoid being effective to move said extension solenoid from said extended to said retracted position upon the receipt of said second electrical signal.

6. Apparatus of claim 5 further comprising means for generating an indicating signal indicative of the condition where said blocking plunger is in said second position.

7. Apparatus of claim 6 in which said means for generating comprises:

a. a cam surface formed on said connecting block;

b. a cam follower movably mounted on an arm and disposed adjacent to said cam surface and effective to engage said cam surface when said extension plunger is moved from said extended position to said retracted position; and c. means connected to said arm for producing said indicating signal when said arm is moved by the engagement of said cam follower with said cam surface.

8. Apparatus of claim 7 in which said means for producing said indicating signal comprises a microswitch to which said arm is connected.

9. Apparatus of claim 6 further comprising a guide roller laterally adjacent to said blocking plunger on the opposite side thereof from said closed end.

10. Apparatus of claim 9 further comprising a support block disposed adjacent to the end of said blocking plunger nearest to said extension plunger when said blocking plunger is in said second position and effective to prevent substantial movement of said blocking plunger in a direction away from said closed end of said slot.

11. Apparatus of claim 10 further comprising a guide bracket disposed adjacent the lateral sides of said extension and said blocking plungers nearest said closed end of said slot and effective to substantially prevent the movement of said blocking and extension plungers in a direction toward said closed end of said slot.

12. Apparatus for locking a bar-actuated release mechanism of a surgical table, which release mechanism is normally effective to release said surgical table from a floor bracket to which it is attached by the movement of said bar in one direction, comprising:

a. a pin attached to said bar and extending normal thereto;

b. a plate having a slot therein, said slot having a closed end adjacent to said pin and extending in said one direction and away from said closed end;

c. a blocking plunger disposed on one axial side of said slot and having its axis perpendiculr to the axes of said pin and said slot, said blocking plunger being axially movable from a first position remote from said slot to a second position in which said blocking plunger is extended across said slot so as to substantially prevent the movement of said pin away from said closed end of said slot; and d. means for displacing said blocking plunger between said first position and said second position and between said second position and said first position.

13. Apparatus of claim 12 in which said means for displacing comprises:

a. an extension plunger parallel to said blocking plunger and disposed on the opposite axial side of said slot from said blocking plunger, said extension plunger being axially movable between an extended position in which said extension plunger is above said slot yet does not interfere with the movement of said pin and a retracted position;

b. a connecting means for connecting the end of said blocking plunger facing said extension plunger to the end of said extension plunger facing said blocking plunger such that said plungers are moved in unison;

c. a first movement means for moving said blocking plunger from said second position to said first position for moving said extension plunger from said retracted position to said extended position; and d. a second movement means for moving said extension plunger from said extended position to said retracted position thereby moving said blocking plunger from said first position to said second position.

14. Apparatus of claim 13 in which said extension plunger is disposed relative to said blocking plunger in a plane parallel to the axis of said pin and the lowermost portion of said extension plunger is above the end of said pin in proximity to said extension plunger.

15. Apparatus of claim 13 in which said first and second movement means are electrically controlled, and said apparatus further comprises means for generating a first electrical signal effective to cause said first movement means to move said blocking plunger from said second position to said first position and for generating a second electrical signal effective to cause said second movement means to move said extension plunger from said extended position to said retracted position.

16. Apparatus of claim 15 in which:

a. said first movement means comprises a first electric pulling solenoid and said blocking plunger comprises the plunger of said first solenoid, the actuation of said first solenoid being effective to move said blocking plunger from said second position to said first position upon the receipt of said first signal; and b. said second movement means comprises a second electric pulling solenoid and said extension plunger comprises the plunger of said second solenoid, the actuation of said second solenoid being effective to move said extension solenoid from said extended to said retracted position upon the receipt of said second electrical signal.

17. Apparatus of claim 16 further comprising means for generating an indicating signal indicative of the condition where said blocking plunger is in said second position.

18. Apparatus of claim 17 in which said means for generating comprises:

a. a cam surface formed on said connecting block;

b. a cam follower movably mounted on an arm and disposed adjacent to said cam surface and effective to engage said cam surface when said extension plunger is moved from said extended position to said retracted position; and c. means connected to said arm for producing said indicating signal when said arm is moved by the engagement of said cam follower with said cam surface.

19. Apparatus of claim 18 in which said means for producing said indicating signal comprises a microswitch to which said arm is connected.

20. Apparatus of claim 19 further comprising a guide roller laterally adjacent to said blocking plunger on the opposite side thereof from said closed end of said slot.

21. Apparatus of claim 20 further comprising a support block disposed adjacent to the end of said blocking plunger nearest to said extension plunger when said blocking plunger is in said second position and effective to prevent substantial movement of said blocking plunger in a direction away from said closed end of said slot.

22. Apparatus of claim 21 further comprising a guide bracket disposed adjacent the lateral sides of said extension and said blocking plungers nearest said closed end of said slot and effective to substantially prevent the movement of said blocking and extension plungers in a direction toward said closed end of said slot.

23. Apparatus of claim 12 in which said surgical table comprises:

a. a base which includes said bar-actuated release mechanism;

b. a support attached to and extending upward from said base; and c. a tabletop supported by said support such that said tabletop may be moved longitudinally and laterally of its longitudinal axis.

* * * * *